US007887154B2

(12) United States Patent
Vladislav

(10) Patent No.: US 7,887,154 B2
(45) **Date of Patent: *Feb. 15, 2011**

(54) INKJET IMAGE FORMING APPARATUS AND METHOD OF COMPENSATING FOR DEFECTIVE NOZZLE THEREOF

(75) Inventor: Terekhov Vladislav, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 149 days.

This patent is subject to a terminal disclaimer.

(21) Appl. No.: 11/522,949

(22) Filed: Sep. 19, 2006

(65) Prior Publication Data

US 2007/0070111 A1 Mar. 29, 2007

(30) Foreign Application Priority Data

Sep. 28, 2005 (KR) ..... 10-2005-0090711

(51) Int. Cl.
*B41J 29/393* (2006.01)
*B41J 29/38* (2006.01)
*B41J 2/21* (2006.01)

(52) U.S. Cl. ..... 347/19; 347/12; 347/43

(58) Field of Classification Search ..... 347/9, 347/12, 14, 19, 43
See application file for complete search history.

(56) References Cited

U.S. PATENT DOCUMENTS 5,581,284 A 12/1996 Hermanson
6,695,435 B1 2/2004 Cheng et al.
7,604,316 B2 * 10/2009 Terekhov et al. ..... 347/14
2002/0158938 A1 * 10/2002 Doval ..... 347/19
2004/0119766 A1 * 6/2004 Shibata et al. ..... 347/12

FOREIGN PATENT DOCUMENTS

JP 11-072612 3/1999
JP 2002-067297 3/2002
JP 2004-58284 2/2004

OTHER PUBLICATIONS

Korean Office Action dated Apr. 10, 2007 issued in KR 2005-90711.

* cited by examiner

*Primary Examiner*—Matthew Luu
*Assistant Examiner*—Jannelle M Lebron
(74) *Attorney, Agent, or Firm*—Stanzione & Kim LLP

(57) ABSTRACT

An inkjet image forming apparatus and a method of defective nozzle compensation in the inkjet image forming apparatus. The method includes detection of an occurrence and a position of the defective nozzle in a nozzle unit, when the defective nozzle is detected, analyzing image information on image data which are to be printed at a compensated position which is a position printed with the defective nozzle and image data which are to be printed at positions adjacent to the compensated position, and exchanging the image data which are to be printed at the compensated position for image data which are to be printed at one of the adjacent positions according to the analyzed image information and performing printing. Missing dots caused by the defective nozzle are compensated by exchanging image data and performing printing. Accordingly, since the image data are exchanged and printed, it is possible to prevent deterioration in image quality such as a white band which can be easily perceived by a user.

29 Claims, 9 Drawing Sheets

INKJET IMAGE FORMING APPARATUS AND METHOD OF COMPENSATING FOR DEFECTIVE NOZZLE THEREOF

CROSS-REFERENCE TO RELATED APPLICATIONS

This application claims priority under 35 U.S.C. §119(a) of Korean Patent Application No. 10-2005-0090711, filed on Sep. 28, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming system, and more particularly, to an inkjet image forming system which can compensate for deterioration in image quality caused by the occurrence of a defective nozzle and a method of compensating for the defective nozzle in the inkjet image forming apparatus.

2. Description of the Related Art

In general, inkjet image forming apparatuses are apparatus which form an image by firing ink with a print head which is separated by a predetermined interval from a printing medium and reciprocates in a direction perpendicular to a conveying direction of the printing medium. Such an inkjet image forming apparatus which forms the image by firing the ink on the printing medium with the print head reciprocating in the direction perpendicular to the conveying direction of the printing medium is called a shuttle type inkjet image forming apparatus. The print head of the shuttle type inkjet image forming apparatus is provided with a nozzle unit including a plurality of nozzles for firing ink.

Recently, high speed printing has been implemented by using a print head having a nozzle unit corresponding to a width of a printing medium instead of a print head reciprocating in a width direction of the printing medium.

Image forming apparatuses operating in such a manner are called a line printing type inkjet image forming apparatus. In the line printing type inkjet image forming apparatus, the print head is disposed in a fixed manner, and only the printing medium is conveyed. Therefore, driving mechanisms of the line printing type inkjet image forming apparatus are simple, and printing can be implemented with high speed.

FIG. 1 is a view illustrating a print pattern at the time of occurrence of a defective nozzle in a conventional inkjet image forming apparatus, and FIGS. 2A to 2D are views illustrating a method of compensating for the defective nozzle in the conventional inkjet image forming apparatus at FIG. 1.

Referring to FIG. 1, the inkjet image forming apparatus prints an image by firing ink I on a printing medium with nozzles 82 provided to a nozzle unit 80. If some of the nozzles 82 of the nozzle unit 80 have a defect, the ink I cannot be normally fired from a defective nozzle 84, so that missing lines occur on the printing medium, as illustrated in FIG. 1. Namely, if some of the nozzles 82 have a defect, the ink I cannot be fired from the defective nozzle 84 on to printing regions of the printing medium, so that white bands such as missing lines occur. Since the white bands of an image printed on the printing medium can be easily seen, the white bands severely affect printing quality. A conventional method of compensating for the deterioration in image quality caused by such defective nozzles is disclosed in U.S. Pat. No. 5,581,284. FIGS. 2A to 2D are views illustrating a process to compensate for the defective nozzle in the conventional method of FIG. 1.

The conventional method is a method of compensating for the occurrence of a defective nozzle in an inkjet image forming apparatus. Here, the defective nozzle denotes a missing nozzle which cannot fire ink or a nozzle which cannot normally fire ink, such as a weak nozzle of which function is weakened. In the conventional method, in a case where defective monochrome (that is, black) nozzles (63 in FIG. 2A) are defected, when the defective nozzle must be used, other colors, that is, cyan, magenta, and yellow are sequentially printed on a same region which must be printed by the defective nozzle 63. An associated process is illustrated in FIGS. 2B, 2C, and 2D in which the same region is sequentially printed with cyan (FIG. 2B), magenta (FIG. 2C), and yellow (FIG. 2D) to compensate for the defective (e.g., black) nozzle. In this process, Process Black dot "P" is formed (FIG. 2D) to represent a summation of a cyan dot (FIG. 2B) and a magenta dot (FIG. 2C) followed finally by a yellow dot (FIG. 2D). In this manner, the cyan, magenta, and yellow are printed on the same region, and a color black can be represented even though the black nozzle is defective. The process is called a process Black or a process Composite Black. However, the method cannot be used in a case where nozzles firing color inks (i.e., cyan, magenta, or yellow) other than black also have a defect. In the case where any one of the nozzles used for compensation also has a defect, the compensation is performed with such colors as red (yellow + magenta), green (cyan + yellow), and blue (cyan + magenta) which are different from the process Black or Composite Black, thus severely affecting the print quality. Therefore, there is a need to improve the print quality by employing a defective nozzle compensation which can compensate not only for a defective black nozzle, but for the defect of one or more compensation nozzles (e.g., cyan, magenta, yellow).

SUMMARY OF THE INVENTION

The present general inventive concept provides an inkjet image forming system and a method of compensating for a defective nozzle to improve image quality.

The present general inventive concept also provides an inkjet image forming system and a method of compensating for a defective nozzle to minimize influence of the defective nozzle on image quality by overcoming a limitation of a conventional compensating method that can only compensate for the black color.

The present general inventive concept also provides an inkjet image forming system and a method of compensating for a defective nozzle to prolong a life time of a print head.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a method of compensating for a defective nozzle in an inkjet image forming system, the method including detecting an occurrence and a position of the defective nozzle in a nozzle unit, when the defective nozzle is detected, analyzing image information on image data which are to be printed at a compensated position which is a position printed with the defective nozzle and image data which are to be printed at positions adjacent to the compensated position, and exchanging the image data which are to be printed at the compensated position with image data which are to be printed at one of the adjacent positions according to the analyzed image information and performing printing with the exchanged image data.

The analyzing of the image information may include comparing color information of the image data which are to be printed at the compensated position with color information of the image data which are to be printed at the adjacent positions. In addition, the analyzing of image information may include, after the color information of the image data which are to be printed at the compensated position is compared with the color information of the image data which are to be printed at the adjacent positions, determining whether there is the image data having a color equal to that of the image data which are to be printed at the compensated position among the image data which are to be printed at the adjacent positions.

The image data which are to be printed at the compensated position may be exchanged with image data formed by firing ink of at least one of the colors of the image data which are to be printed at the adjacent positions.

The image data which are to be printed at the compensated position may be exchanged with image data not including ink having a color equal to that of the defective nozzle among the image data which are to be printed at the adjacent positions. In addition, image data having the color equal to that of the image data which are to be printed at the adjacent positions may be selected as the exchanged image data and may be printed at the compensated position.

The image data having colors equal to those of the image data which are to be printed at the compensated position may be printed at the adjacent positions and printed with the exchanged image data.

The image data which are to be printed at the compensated position may be exchanged with the image data having chroma similar to those of the image data which are to be printed at the compensated position among the image data which are to be printed at the adjacent positions.

The image data which are to be printed at the compensated position may have a black color. In addition, black ink may be fired at the adjacent positions according to the exchanged image data. In addition, cyan, magenta, and yellow ink may be fired at the adjacent positions according to the exchanged image data.

The exchange and printing of the image data may be performed by exchanging and transmitting the driving data transmitted to nozzles of the nozzle unit.

The adjacent positions may include left, upper left, and lower left, right, upper right, and lower right positions of the compensated position.

The nozzle unit may have a length greater than or equal to a width of a printing medium.

The method may further include, when the defective nozzle is detected, performing a maintenance operation to recover the nozzle unit to a printing standby state. In addition, the method may further include, after the maintenance operation is performed, detecting the occurrence and the position of the defective nozzle in the nozzle unit.

The foregoing and/or other aspects of the present general inventive concept may also be achieved by providing an inkjet image forming system including a print head having a nozzle unit firing ink, a driving member to drive the nozzle unit to form an image on a printing medium, a defective nozzle detection unit to detect an occurrence and a position of the defective nozzle in the nozzle unit, and a control unit to control an operation of the driving member to exchange image data which are to be printed at a compensated position, which is a position printed by the defective nozzle with image data which are to be printed at one of positions adjacent to the compensated position and to perform printing using the exchanged image data when the defective nozzle is detected.

The control unit may control an operation of the driving member to exchange the image data which are to be printed at the compensated position with the image data not including ink having a color equal to that of the defective nozzle among the image data which are to be printed at the adjacent positions.

The control unit may control an operation of the driving member to exchange image data which are to be printed at the compensated position with image data having chroma similar to that of the image data which are to be printed at the compensated position among the image data which are to be printed at the adjacent positions.

The nozzle unit may have a length greater than or equal to a width of the printing medium.

The foregoing and/or other aspects of the present general inventive concept may also be achieved by providing a method of compensating a defective nozzle in an inkjet image forming system, the method including detecting an occurrence of the defective nozzle in a nozzle unit, when the defective nozzle is detected, performing a maintenance operation to recover the nozzle unit, determining whether the defective nozzle is recovered or continues to be defective, when the defective nozzle continues to be defective detecting a position of the defective nozzle, analyzing image information on image data which are to be printed at a compensated position which is a position printed using the defective nozzle and image data which are to be printed at positions adjacent to the compensated position, and exchanging the image data which are to be printed at the compensated position with the image data which are to be printed at one of the adjacent positions according to the analyzed image information, and performing printing of the exchanged image data.

The foregoing and/or other aspects of the present general inventive concept may also be achieved by providing a method of compensating a defective nozzle in an inkjet image forming system including detecting an occurrence of the defective nozzle in a nozzle unit, and performing printing with image data which are to be printed at a position adjacent to a compensated position which is in a position printed using the defective nozzle.

The foregoing and/or other aspects of the present general inventive concept may also be achieved by providing an inkjet image forming system including a print head having a nozzle unit to fire ink, a driving member to receive image data and to drive the nozzle unit to form an image on a printing medium, a defective nozzle detection unit to detect a defective nozzle in the nozzle unit, and a control unit to control an operation of the driving member and the print head to print with image data which are to be printed at a position adjacent to a compensated position which is in a position printed using the defective nozzle.

The foregoing and/or other aspects of the present general inventive concept may also be achieved by providing an image forming system including a data input unit to receive and transmit image data and to generate commands, and an image forming apparatus to receive the transmitted image data and the generated commands from the data input unit and to form an image based on the received image data and commands, the image forming apparatus including a print head having a nozzle unit to fire ink, a driving member to drive the nozzle unit to form an image on a printing medium, a defective nozzle detection unit to detect an occurrence and a position of a defective nozzle in the nozzle unit, a maintenance unit to recover the defective nozzle unit when the occurrence of the defective nozzle is detected, and a control unit to control an operation of the driving member based on the generated commands and to analyze image information on received image data which are to be printed at a compensated position which is a position printed using the defective nozzle and image data which are to be printed at positions adjacent to the compensated position, and to exchange the received image data which are to be printed at the compensated position with the received image data which are to be printed at the adjacent positions and to print the exchanged image data.

The foregoing and/or other aspect of the present general inventive concept may also be achieved by providing a computer-readable medium having embodied thereon a computer program to execute a method of compensating for a defective nozzle in an inkjet image forming system, the method including detecting an occurrence and a position of the defective nozzle in a nozzle unit, when the defective nozzle is detected, analyzing image information on image data which are to be printed at a compensated position which is a position printed with the defective nozzle and image data which are to be printed at positions adjacent to the compensated position, and exchanging the image data which are to be printed at the compensated position with image data which are to be printed at one of the adjacent positions according to the analyzed image information and performing printing with the exchanged image data.

The foregoing and/or other aspect of the present general inventive concept may also be achieved by providing a computer-readable medium having embodied thereon a computer program to execute a method of compensating a defective nozzle in an inkjet image forming system, the method including detecting an occurrence of the defective nozzle in a nozzle unit, when the defective nozzle is detected, performing a maintenance operation to recover the nozzle unit, determining whether the defective nozzle is recovered or continues to be defective, when the defective nozzle continues to be defective detecting a position of the defective nozzle, analyzing image information on image data which are to be printed at a compensated position which is a position printed using the defective nozzle and image data which are to be printed at positions adjacent to the compensated position, and exchanging the image data which are to be printed at the compensated position with the image data which are to be printed at one of the adjacent positions according to the analyzed image information, and performing printing of the exchanged image data.

The foregoing and/or other aspect of the present general inventive concept may also be achieved by providing a computer-readable medium having embodied thereon a computer program to execute a method of compensating a defective nozzle in an inkjet image forming system including detecting an occurrence of the defective nozzle in a nozzle unit, and performing printing with image data which are to be printed at a position adjacent to a compensated position which is in a position printed using the defective nozzle.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
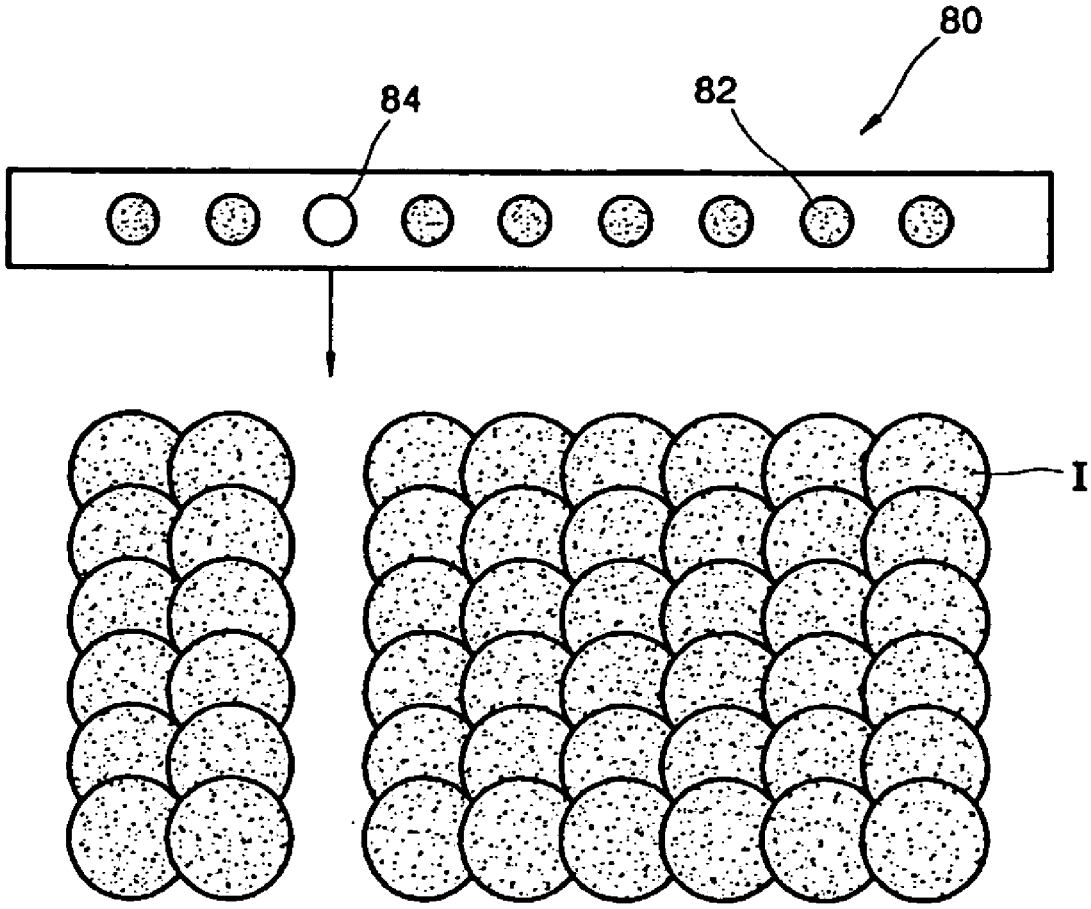
FIG. 1 (PRIOR ART)
FIG. 1 is a view illustrating a print pattern in a case where a nozzle unit of a conventional line printing type inkjet image forming apparatus has a defect.
Figure 2A:
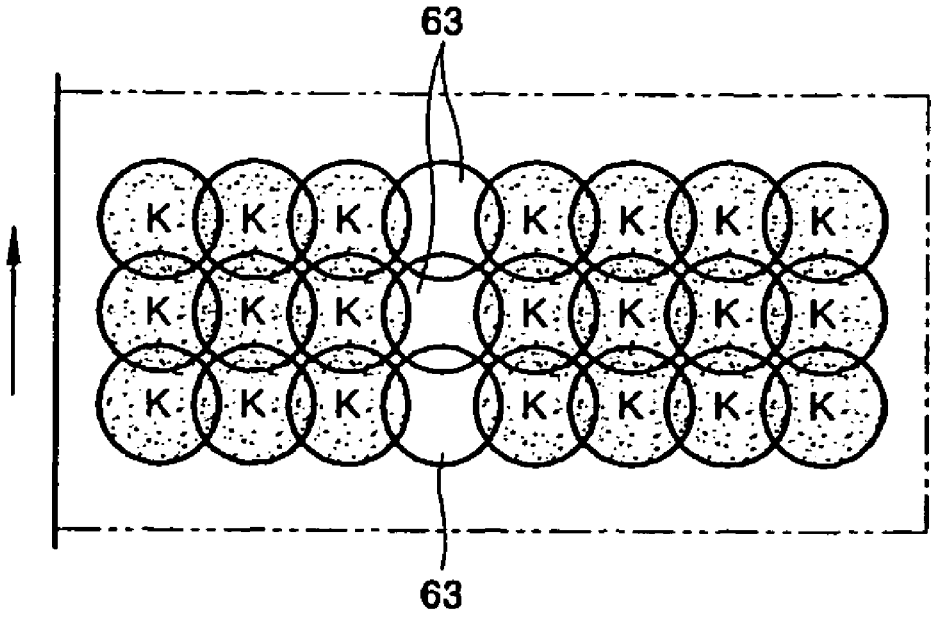
FIG. 2A (PRIOR ART)
FIGS. 2A to 2D are views illustrating a process to compensate for a defective nozzle unit in the conventional inkjet image forming apparatus of FIG. 1.
Figure 2B:
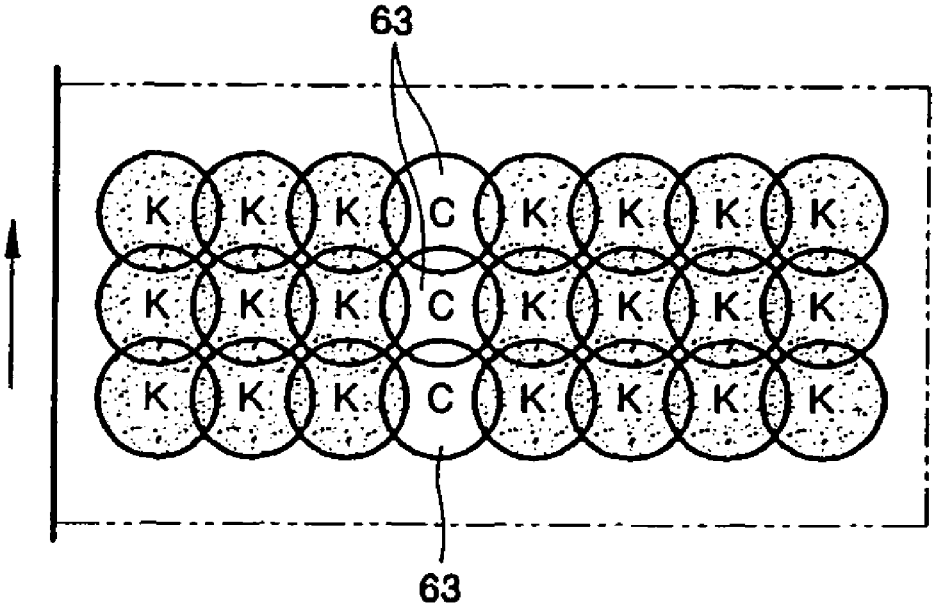
FIG. 2B (PRIOR ART)
Figure 2C:
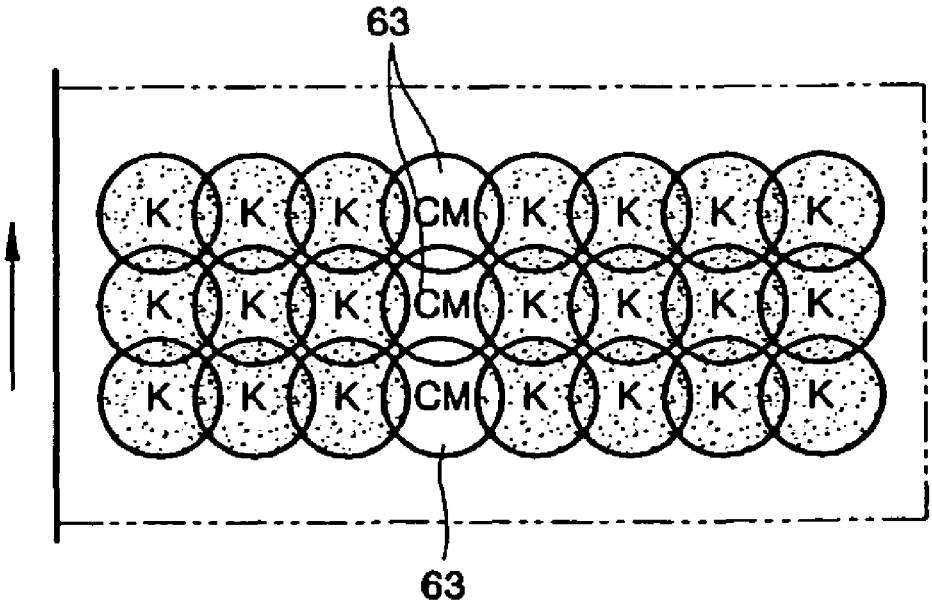
FIG. 2C (PRIOR ART)
Figure 2D:
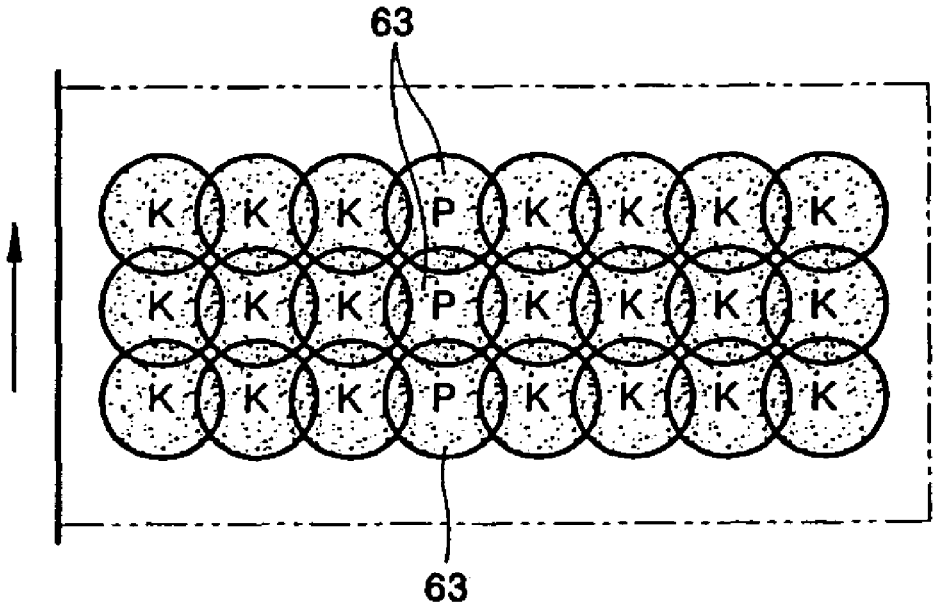
FIG. 2D (PRIOR ART)

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
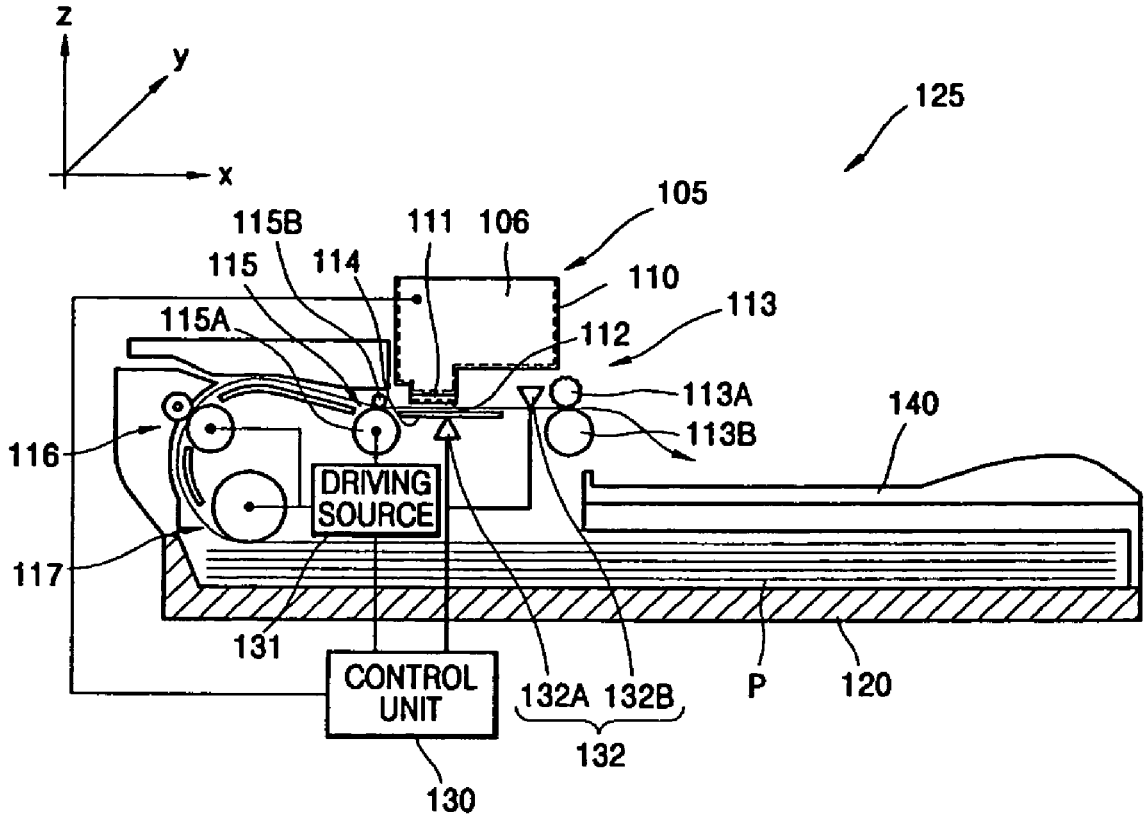
FIG. 3 is a schematic view illustrating an inkjet image forming apparatus according to an embodiment of the present general inventive concept.
Figure 4:
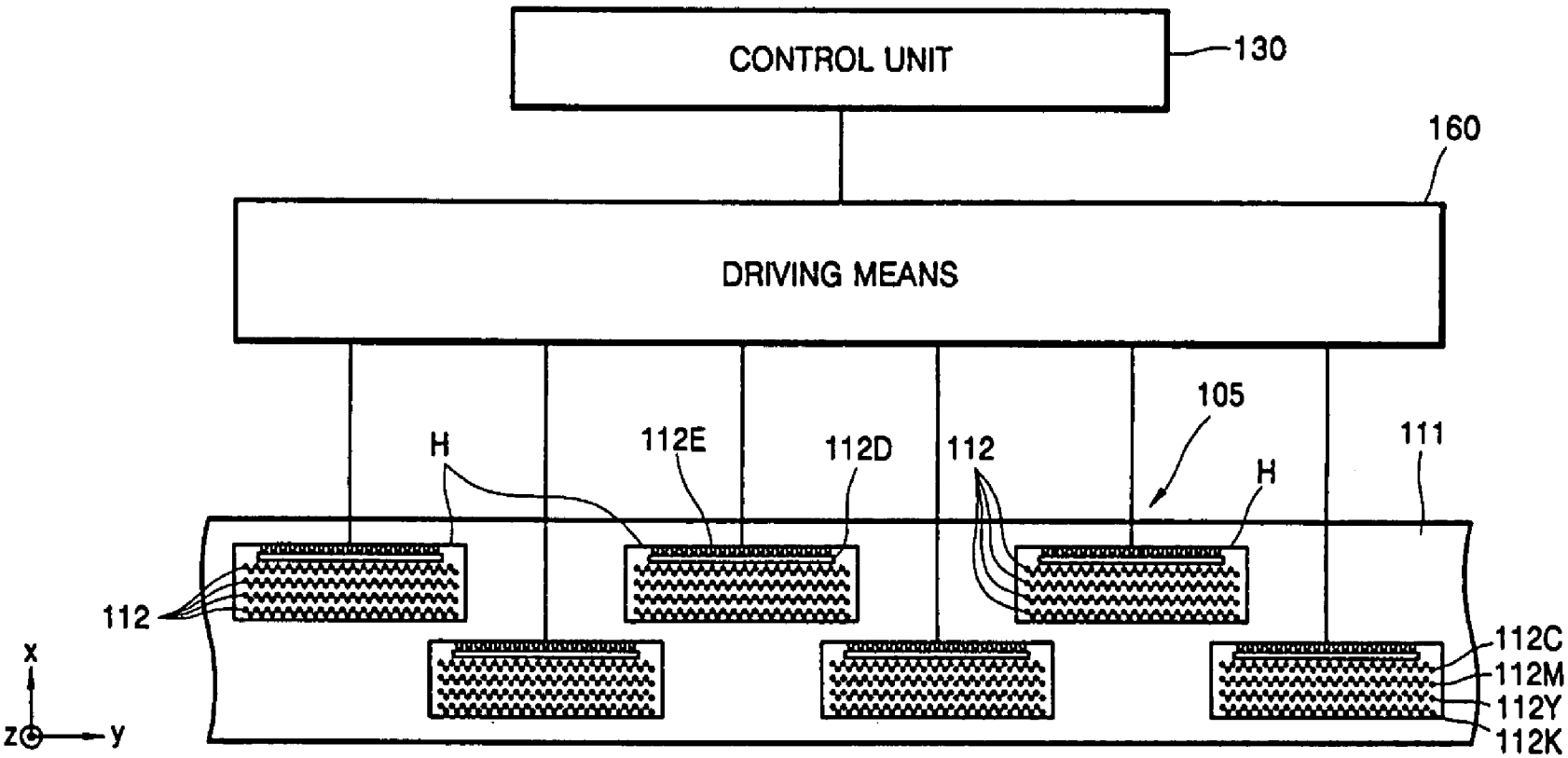
FIG. 4 is a view illustrating a driving mechanism for a print head of the inkjet image forming apparatus of FIG. 3.

FIG. 3 is a schematic view illustrating an inkjet image forming apparatus 125 according to an embodiment of the present general inventive concept, and FIG. 4 is a view illustrating a driving mechanism for a print head.

Referring to FIGS. 3 and 4, the inkjet image forming apparatus 125 includes a paper-feeding cassette 120, a print head unit 105, a supporting member 114 facing the print head unit 105, a defective nozzle detection unit 132 to detect an occurrence and a position of the defective nozzle of a nozzle unit 112, a printing medium conveying unit to convey a printing medium P in a first direction (x direction), and a loading unit 140 in which an ejected printing medium P is loaded. In addition, the inkjet image forming apparatus 125 includes driving member (driving means) 160 and a control unit 130 to control operations of components of the apparatus.

The printing medium P is loaded on the paper-feeding cassette 120. The printing medium P loaded on the paper-feeding cassette 120 passes through the print head 111 and is conveyed to the loading unit 140 by the later-described printing medium conveying unit. The loading unit 140 denotes such a component as an ejected-paper tray on which the ejected printing medium P is loaded.

The printing medium conveying unit which is a component for conveying the printing medium P loaded on the paper-feeding cassette 120 along a predetermined path includes a pickup roller 117, auxiliary rollers 116, feeding rollers 115, and a paper ejecting rollers 113. The printing medium conveying unit is driven by a driving source 131 such as a motor and provides a conveying force which is exerted on the printing medium P. Operations of the driving source 131 are controlled by the later-described control unit 130.

The pickup roller 117 is disposed at one side of the paper-feeding cassette 120 and picks up and draws out the printing medium P loaded on the paper-feeding cassette 120 one-by-one. The feeding rollers 115 are disposed at an input side of the print head 111 and feed the printing medium P drawn out by the pickup roller 117 to the print head 111. The feeding rollers 115 include a driving roller 115A to exert a conveying force on the printing medium P and an idle roller 115B which is elastically engaged with the driving roller 115A. A pair of the auxiliary rollers 116 to convey the printing medium P may be further disposed between the pickup roller 117 and the feeding rollers 115. The paper ejecting rollers 113 are disposed at an output side of the print head 111 and eject the printing-finished printing medium P from the image forming apparatus 125. The paper ejecting rollers 113 include a star wheel 113A disposed in a width direction of the printing medium P and a supporting roller 113B disposed to face the star wheel 113A to support a rear surface of the printing medium P. The star wheel 113A can prevent the printing medium P (conveyed under nozzle unit 112) from contacting the nozzle unit 112 or a bottom surface of a body 110 or can prevent a gap between the printing medium P and the nozzle unit 112 from changing. Therefore, at least a portion of the star wheel 113A is disposed to protrude from the nozzle unit 112 and contact a front surface of the printing medium P in a point-wise contact manner. The printing medium P ejected from the image forming apparatus 125 is loaded on the loading unit 140.

The supporting member 114 is disposed under the print head 111 so as to maintain a predetermined gap between the nozzle unit 112 and the printing medium P and supports the rear surface of the conveyed printing medium P. The gap between the nozzle unit 112 and the printing medium P may be in a range of from about 0.5 mm to about 2.5 mm.

The defective nozzle detection unit 132 detects an occurrence and a position of a defective nozzle occurring during manufacturing processes or printing operations. In addition to the defective nozzle, the defective nozzle detection unit 132 checks firing states of nozzles adjacent to the defective nozzle. More specifically, after checking spaying states of nozzles of the nozzle unit 112, the defective nozzle detection unit 132 transmits information on the firing states to a memory unit 171 (see FIG. 6). Here, the defective nozzle denotes a nozzle which cannot normally fire ink such as a dead nozzle (which cannot fire ink) and a weak nozzle (which has a weak firing function). In other words, the defective nozzle denotes a nozzle which cannot fire ink or a nozzle which fires a smaller amount of ink than a predetermined amount.

The defective nozzle may occur during a process of manufacturing the print head 111 or during printing operations. In general, information on the defective nozzle occurring during the manufacturing process is separately stored in a memory not shown) provided to the print head 111, and the information is transmitted to the image forming apparatus 125 when the print head 111 is mounted on the image forming apparatus 125.

In general, the print head of the inkjet image forming apparatus is mainly classified into two types according to a type of actuator which provides a firing force to ink droplets. One is a thermal driving type where a heater is used to generate bubbles in ink and fire the ink droplets with an expansion force of the bubbles, and the other is a piezoelectric driving type where a piezoelectric device is used to fire the ink droplets with a pressure which is exerted on the ink due to deformation of the piezoelectric device. In the thermal driving type of firing the ink, it is easy to detect nozzle defects generated due to disconnection of the heater used to fire the ink, malfunction of a driving circuit of the heater, or malfunction of components such as field emission transistors (FETs). Similarly, in the piezoelectric driving type of firing the ink, it is easy to detect nozzle defects generated due to malfunction of the piezoelectric device or malfunction of a driving circuit of the piezoelectric device.

However, unlike the aforementioned cases, in some cases such as a case where the nozzles are clogged with extraneous materials, a cause of an occurrence of the defective nozzle may not be easily determined. In such a case where the cause of the occurrence of the defective nozzle can not be easily determined, a test page is printed.

If a nozzle becomes defective, a printing concentration of portions printed with the defective nozzle is lower that that of portions printed with normal nozzles due to missing dots. Therefore, by using a printing concentration difference, the occurrence and position of the defective nozzle can be detected.

In one aspect of the present general inventive concept, the defective nozzle detection unit 132 includes a first detection unit 132A and a second detection unit 132B. In the present embodiment, the first detection unit 132A detects whether or not the nozzles are clogged by illuminating light on the nozzle unit 112, and second detection unit 132B detects the occurrence of the defective nozzle by illuminating light on the printing medium P. As an example, the defective nozzle detection unit 132 includes an optical sensor. The optical sensor includes a light emitting sensor (for example, a light emitting diode) illuminating light on the nozzle unit 112 or the printing medium P and a light receiving sensor receiving light reflected from the nozzle unit 112 or the printing medium P. The defective nozzle detection unit 132 detects the occurrence of the defective nozzle according to an output signal from the light receiving sensor and transmits information on the occurrence of the defective nozzle to the later-described control unit 130. Here, the light emitting sensor and the light receiving sensor may be constructed integrally or separately. A construction and operation of the optical sensor are well known, and therefore, detailed description thereto is omitted.

Although not shown in the figures, as an alternative example, the defective nozzle detection unit may transmit a nozzle check signal to nozzles of the print head and detect the occurrence and position of the defective nozzle in response to the transmitted nozzle check signal.

Such a defective nozzle detecting method is well known, and therefore, detail description thereto is omitted. In addition, well-known various apparatuses and methods may be used to detect the occurrence and position of the defective nozzle.

The defective nozzle detection unit 132 detects the occurrence and position of the defective nozzle by using a series of the aforementioned processes. Information on the defective nozzle detected by the defective nozzle detection unit 132 is stored in a memory (not shown), and the control unit 130 controls operations of components to compensate for the defective nozzle based on the defective nozzle information stored in the memory (not shown). Here, the defective nozzle information includes a position of the defective nozzle, colors of ink fired by the defective nozzle, and the like.

The print head unit 105 is a component which fires ink on the printing medium P to print an image and includes a body 110, the print head 111 provided to one side of the body 110, the nozzle unit 112 provided in the print head 111, and a carriage 106 on which the body 110 is mounted. The body 110 is mounted on the carriage 106 as a cartridge. Feeding rollers 115 and paper ejecting rollers 113 are pivotally provided to an input side and an output side of the nozzle unit 112, respectively.

Although not shown in FIG. 3, an ink containing space to contain ink is provided in the body 110. In addition, the body 110 may further include chambers provided with a driving member (for example, the piezoelectric driving type device or the thermal driving type heater) connected to the nozzles of the nozzle unit 112 to provide a pressure to fire the ink, pipe lines (for example, orifices) to supply the ink contained in the body 110 to the chambers, a manifold which is a common pipe line to supply the ink flowing in through the pipe lines to the chambers, restrictors which are individual pipe lines to supply the ink from the manifold to the chambers, and the like. The chamber, the pipe lines, the manifold, and the restrictors are well-known, and therefore, detailed description is omitted. On the other hand, the ink containing space which contains the ink may be separately provided from the print head unit 105. The ink contained in the ink containing space (not shown) may be supplied to the print head unit 105 through a transporting member such as a hose.

Referring to FIG. 4, a driving member (driving means) 160 is a component which provides a firing force to fire ink droplets and which drives the nozzle unit 112 at a predetermined frequency to print an image on the printing medium P The driving member 160 may be classified into two types according to a kind of actuator used to provide the firing force to the ink droplets. As described above, one type is the thermal driving type where the ink droplets are fired using the heater, and the other type is the piezoelectric device type where the ink droplets are fired using the piezoelectric device. The driving operation of the driving member 160 to drive the nozzles is controlled by the later-described control unit 130.

In general, the print head 111 may be classified either as a shuttle type where the print head 111 reciprocates in a direction perpendicular to a conveying direction of the printing medium P to print an image or a line printing type where the print head 111 has a length corresponding to a width of the printing medium P. In the line printing type print head, when the printing medium P is fed in a feeding direction by the feeding rollers 115 and/or the paper ejecting rollers 113, the length of the print head 111 is equal to or greater than the width of the printing medium P in a direction perpendicular to the feeding direction. For example, when the printing medium P is a sheet of paper of a letter size, that is, the width of eight and a half inches in the direction and the length of eleven inches in the feeding direction, the length of the print head 111 is equal to or greater than the width of the eight and a half inches. The present general inventive concept can be applied to both the shuttle type and the line printing type inkjet image forming apparatuses. Hereinafter, for convenience of description, the line printing type print head will be exemplified.

Referring to FIGS. 3 and 4, the print head 111 is disposed in a second direction (y direction) along the width of the printing medium P which is conveyed in a first direction (x direction). The print head 111 may use thermal energy, a piezoelectric device, and the like as an ink firing power source and may be manufactured to have a high resolution through use of semiconductor manufacturing processes such as etching, depositing, and sputtering processes. The print head 111 is provided with a nozzle unit 112 to fire the ink onto the printing medium P to print the image.

The nozzle unit 112 may be constructed to have a length corresponding to the width of the printing medium P or larger than the width of the printing medium P. As illustrated in FIGS. 3 and 4, a plurality of head chips H where a large number of nozzle rows 112C, 112M, 112Y, and 112K, are formed may be provided to the print head H. Here, reference numerals 112C, 112M, 112Y, and 112K denote cyan, magenta, yellow, and black nozzle rows, respectively. On the other hand, each of the head chips H may be manufactured with a single chip corresponding to the length of the print head 111, which may be equal to the width of the printing medium P.

Although the print head 111 is exemplified here as a line printing type having the nozzle unit 112 constructed with a large number of the head chips H, the print head 111 may be constructed in various other ways. For example, the inkjet image forming apparatus according to the present general inventive concept may be constructed as a shuttle type print head. Namely, the print head 111 and the nozzle unit 112 are only one embodiment of the present general inventive concept, and therefore, the scope of the present general inventive concept is not limited thereto.

In addition, a driving circuit 112 D and cables 112E to which driving signals, an ink firing power, and image data are transmitted from the later-described control unit 130 (see FIG. 4) are connected to each of the nozzles provided in the nozzle unit 112. Preferably, flexible cables such as a flexible printed circuit (FPC) and a flexible flat cable (FFC) may be used for the cables 112E.

Figure 5:
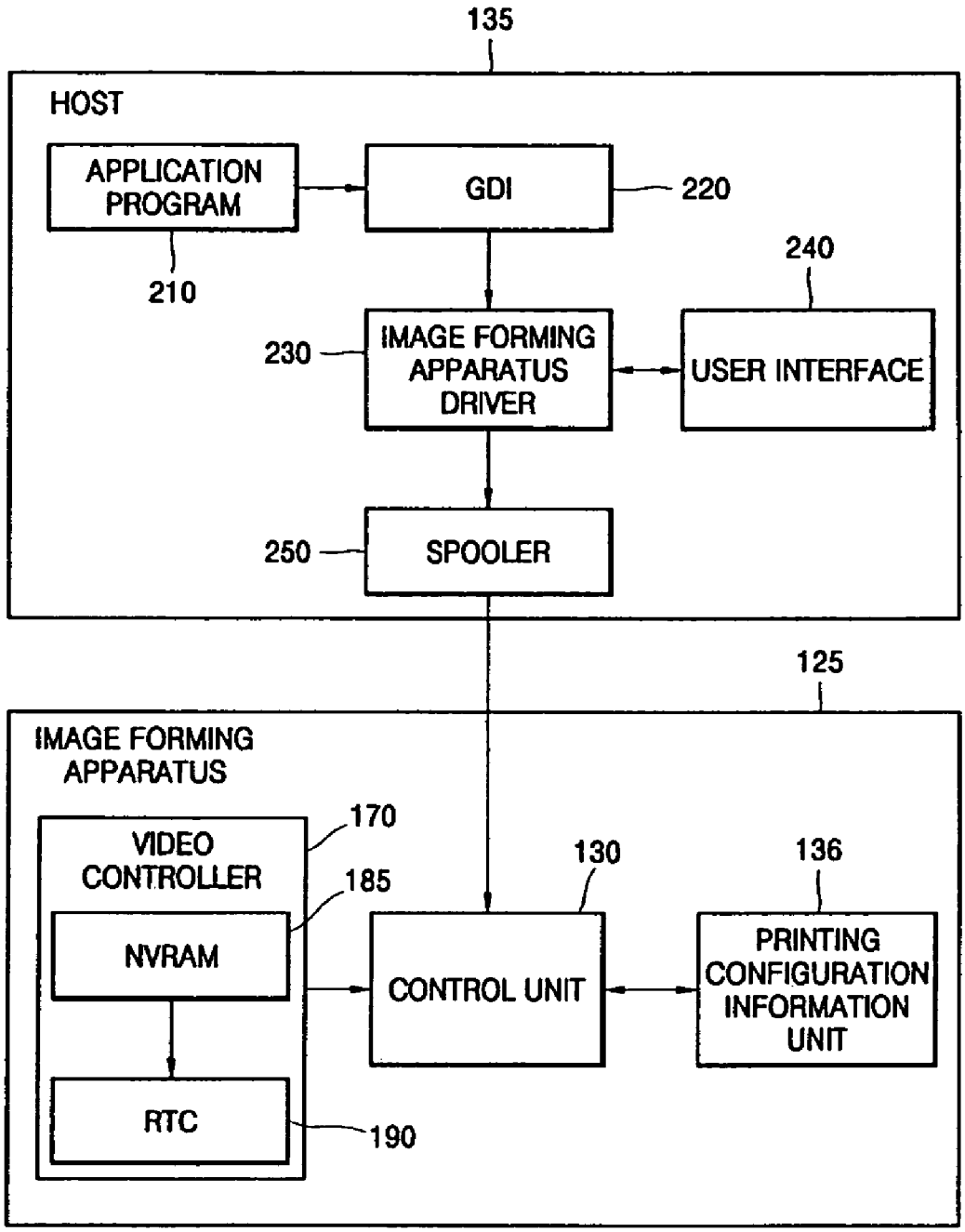
FIG. 5 is a block diagram illustrating an image forming system according to an embodiment of the present general inventive concept.
Figure 6:
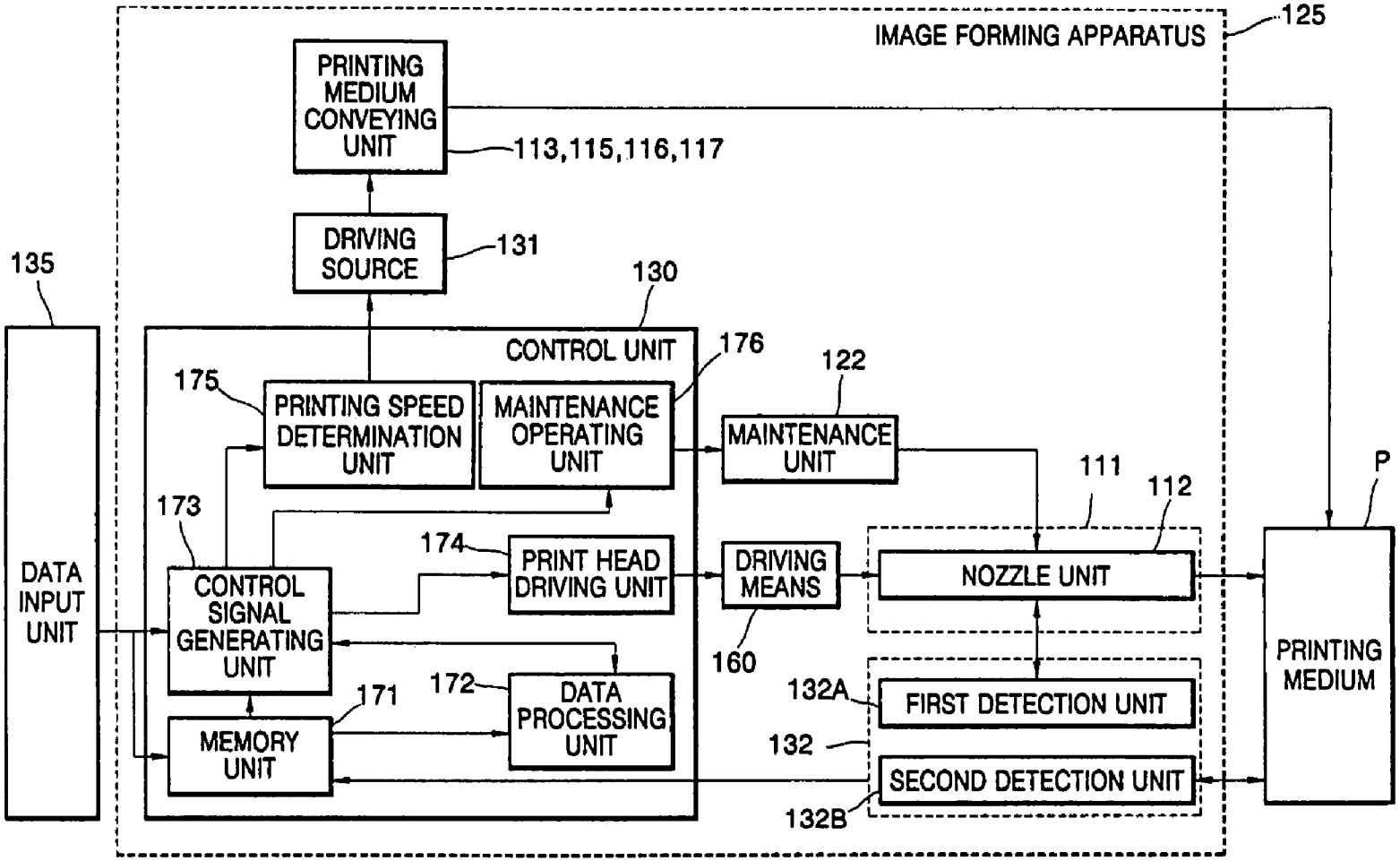
FIG. 6 is a block diagram illustrating an inkjet image forming apparatus of the image forming system of FIG. 5.

FIG. 5 is a block diagram illustrating an image forming system according to an embodiment of the present general inventive concept, and FIG. 6 is a block diagram illustrating the inkjet image forming apparatus 125 of the image forming system of FIG. 5. Here, the image forming system includes a data input unit 135 and the inkjet image forming apparatus 125.

Referring to FIGS. 5 and 6, the data input unit 135 denotes a host system such as a personal computer (PC), a digital camera, or a personal digital assistant (PDA), and receives to-be-printed image data in an order of pages to be printed. The data input unit 135 includes an application program 210, a graphics device interface (GDI) 220, an image forming apparatus driver 230, a user interface 240, and a spooler 250.

The application program 210 has a function of generating and editing an object which can be output by using the image forming apparatus 125. The GDI 220 includes a program existing in an operating system (OS) on the host system receives an object generated by the application program 210, transmits the object to the image forming apparatus driver 230, and generates commands on the object requested by the image forming apparatus driver 230. The image forming apparatus driver 230 includes a program existing on the host system to generate commands which can be analyzed by the image forming apparatus 125. The user interface 240 to communicate with the image forming apparatus driver 230 includes a program existing on the host system and provides configuration variables in which the image forming apparatus driver 230 generates the commands. A user uses the user interface 240 to select a printing mode such as a draft mode, a normal mode, or a high-resolution mode and a kind of printing medium P such as a plain paper, a photo paper, or a transparent film. The spooler 250 includes a program existing on an operating system in the host system and transmits commands generated by the image forming apparatus driver 230 to input/output units (not shown) connected to the image forming apparatus 125.

The image forming apparatus 125 includes a video controller 170, a control unit 130, and a printing configuration information unit 136. In addition, the video controller 170 includes a non-volatile memory (NVRAM; non-volatile random access memory) 185, an SRAM (not shown), an SDRAM (not shown), a NOR flash (not shown), and a real time clock (RTC) 190. The video controller 170 analyzes the commands generated by the image forming apparatus driver 230, generates associated bitmaps, and transmits the bitmaps to the control unit 130. The control unit 130 transmits the bitmaps generated by the video controller 170 to components of the image forming apparatus 125 to form an image on the printing medium P. Through the aforementioned process, the printing is performed by the image forming apparatus 125.

Referring to FIG. 6, a maintenance unit 122 is a unit to maintain the nozzle unit 112 in a printing standby state in order to achieve high image quality. Although not illustrated in FIG. 6, the maintenance unit 122 includes a capping device to cap the nozzle unit 112, a wiping device to wipe the nozzle unit 112, and an ink receiving portion (not shown) to receive and store a small amount of ink fired from the nozzle unit 112 during a spitting operation. The operation of the maintenance unit 122 is controlled by the later-described control unit 130. For example, when the defective nozzle is detected, the control unit 130 controls the maintenance operating unit 176 to drive the maintenance unit 122.

In a case where a printing operation is not performed in a predetermined time, or a case where there is a nozzle from which the ink is not fired in a predetermined time during the printing operation, a firing failure may be caused by dried ink on a surface of the nozzle or by an increase in viscosity of the ink. The spitting operation removes the high viscosity ink by spitting a small amount of the ink several times. Namely, in order to prevent abnormal firing due to the drying of the ink firing nozzle, the spitting operation spits the ink through the ink firing nozzle before or during the printing operation.

If an amount of the ink remaining on a surface of nozzle unit 112 increases, a trajectory of ink droplets is deflected, causing a serious decrease in printing quality. The wiping device (not shown) removes a solidified ink or ink remaining around the nozzle by rubbing the surface of the nozzle unit 112.

In addition, in a case where the inkjet image forming apparatus is not used for a long time or in case of printing standby, the ink of the nozzle unit 112 provided to the print head 111 may be dried or contaminated by dust. The capping device covers the nozzle unit 112 to block an external atmosphere when the nozzle unit 112 is not used within a predetermined time, so that the drying or contamination of the ink of the nozzle unit 112 can be prevented. In addition, suction may be used to clean a portion of firing ink by sucking a portion of ink remaining in nozzle openings of the nozzles of the nozzle unit 112. The construction and operation of the maintenance unit 122 are well-known, and therefore, detailed description and drawings are omitted.

Referring again to FIG. 5, the printing configuration information unit 136 stores a plurality of printing configuration information corresponding to a printing configuration when the image data input from the application program 210 is printed in predetermined printing configurations. Namely, the printing configuration information unit 136 stores the printing configuration information input from the user interface 240 corresponding to the printing configurations. Here, the printing configuration denotes at least one of a printing mode, a kind of printing medium, a printing density, a resolution, a size of printing medium, a usage temperature, a usage humidity, and a sequential printing mode. Referring again to FIG. 6, the control unit 130 controls operations of the driving member (driving means) 160 or the driving source 131 according to the printing configuration information stored in the printing configuration information unit 136 corresponding to the printing configurations.

The control unit 130 is provided on a mother board of the inkjet image forming apparatus 125 and controls a firing operation of the nozzle unit 112 of the print head 111, an operation of the maintenance unit 122, an operation of the printing medium conveying unit, and the like according to the occurrence of the defective nozzle detected by the defective nozzle detection unit 132. As illustrated in FIG. 6, the control unit 130 includes a memory unit 171, a data processing unit 172, a control signal generation unit 173, a printer head driving unit 174, a printing speed determination unit 175, and a maintenance operating unit 176.

The control unit 130 controls the image data input from the data input unit 135 to be stored in the memory unit 171 and checks whether or not the storing of the to-be-printed image data in the memory unit 171 is completed. In addition, information (for example, a position of the defective nozzle) on the defective nozzle detected by the defective nozzle detection unit 132 is stored in the memory unit 171.

The data processing unit 172 analyzes image information of image data which are to be printed at a compensated position and image data which are to be printed at adjacent positions based on the information on the defective nozzle stored in the memory unit 171. Here, the compensated position denotes a position on the printing medium printed with the defective nozzle in a case where the ink is normally fired from the defective nozzle, and the adjacent positions denote positions adjacent to the compensated position. In addition, the image data which are to be printed at the compensated position are exchanged with image data which are to be printed at one of the adjacent positions according to the image information analyzed by the data processing unit 172, and the printing is performed. Namely, the data processing unit 172 exchanges the image data which are to be printed by the defective nozzle among the image data input from the data input unit 135 with the image data of the adjacent positions and performs the printing.

The control signal generation unit 173 generates control signals to control operations of the printer head driving unit 174, the printing speed determination unit 175, and the maintenance operating unit 176 according to the image data and the defective nozzle information transmitted from the memory unit 171 and the data processing unit 172 and outputs the control signals.

The printer head driving unit 174 receives the control signals from the control signal generation unit 173 and drives the driving member 160 according to the generated control signal to print an image on the printing medium P.

The printing speed determination unit 175 receives the control signals from the control signal generation unit 173 to drive the driving source 131. The printing medium conveying unit receives power from the driving source 131 and conveys the printing medium P along a predetermined path.

The maintenance operating unit 176 receives the control signals from the control signal generation unit 173 to drive the maintenance unit 122 to maintain the nozzle unit 112 in a printing standby state.

Figure 7:
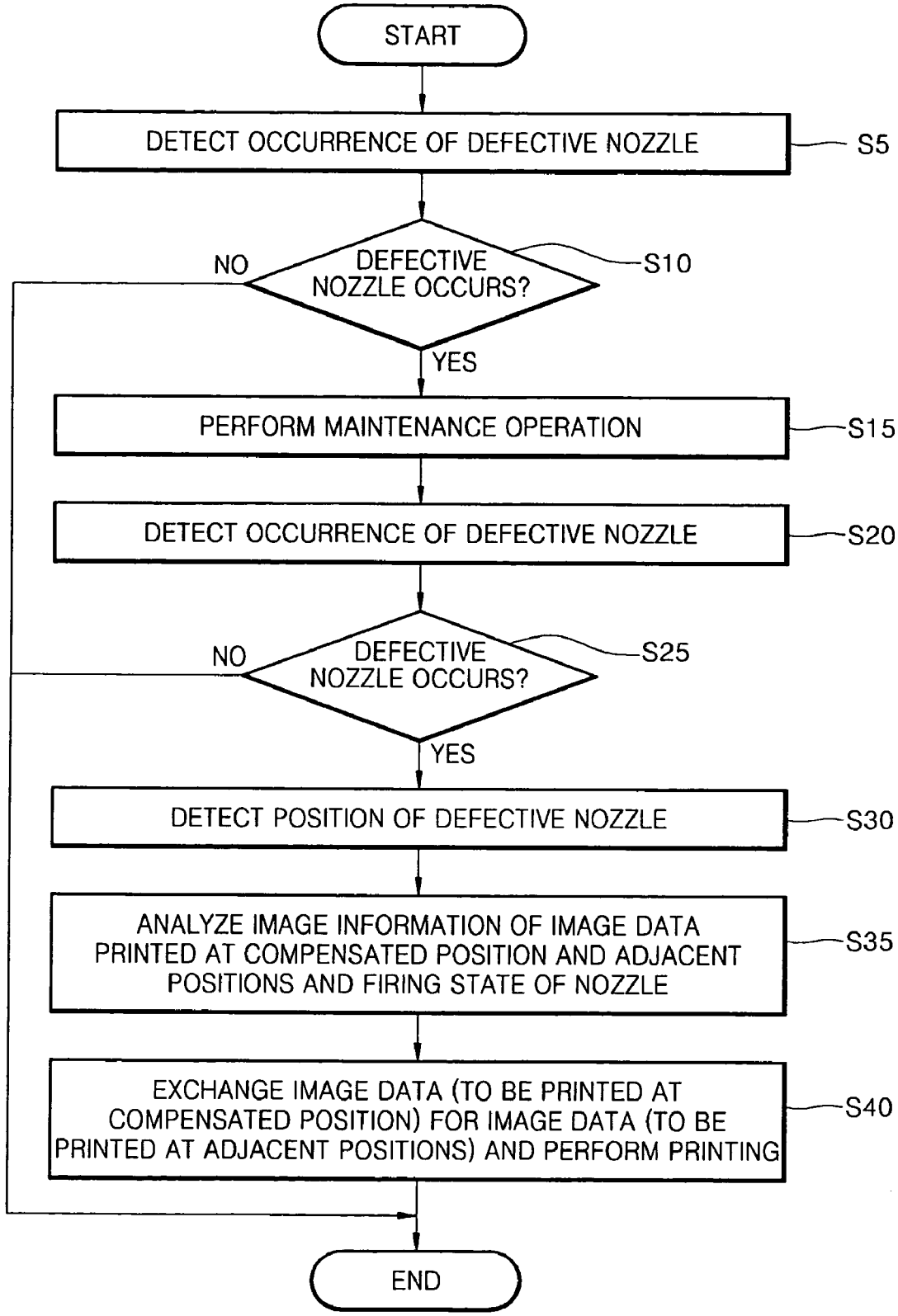
FIG. 7 is a flowchart illustrating a method of compensating for a defective nozzle in an inkjet image forming system according to an embodiment of the present general inventive concept.

Now, operations of the control unit 130 will be described in detail with reference to a flowchart of FIG. 7 illustrating a method of defective nozzle compensation according to the present embodiment.

Figure 8:
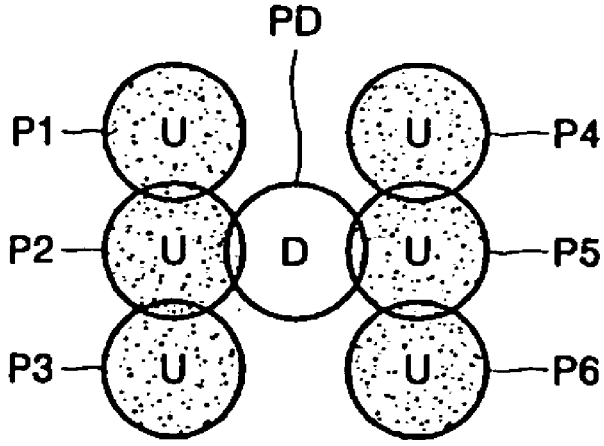
FIG. 8 is a view illustrating a compensated position of an ink dot and positions of the ink dots disposed adjacent to the compensated position.

FIG. 7 is a flowchart illustrating a method of compensating for a defective nozzle in an inkjet image forming system according to an embodiment of the present general inventive concept, and. FIG. 8 is a view illustrating a compensated position and positions adjacent thereto. In FIG. 8, reference numeral PD denotes a compensated position which is a position printed with a defective nozzle, and reference numerals P1, P2, P3, P4, P5, and P6 denote positions adjacent to the compensated position. In the present embodiment, the adjacent positions may include a left position P2, an upper left position P1, a lower left position P3, a right position P5, an upper right position P4, and a lower right position P6. In addition, reference numeral D shows an ink dot which is fired from the defective nozzle and impacted on a printing medium, and reference numeral U shows an ink dot which is fired from an arbitrary nozzle and impacted on the printing medium. In addition, image data printed at the compensated and adjacent positions may be formed with ink fired by a single nozzle or with ink fired by two nozzles or more.

Referring to FIGS. 5 to 7, the defective nozzle detection unit 132 detects an occurrence and a position of a defective nozzle of the nozzle unit 112 (S5). After information on the defective nozzle is stored in the memory unit 171, the information on the defective nozzle is transmitted to the data processing unit 172 and the control signal generation unit 173. Since the method of detecting the defective nozzle is the same as described above with respect to FIGS. 5 and 6, detailed description thereto is omitted.

If any defective nozzles are not detected, the control unit 130 prints an image by driving the nozzle unit 112 in synchronization with the entering of a printing medium P to the nozzle unit 112. At this time, the control signal generation unit 173 generates control signals to control the printer head driving unit 174 to print an image on the printing medium P and outputs the control signals. The driving member 160 receives the control signals from the printer head driving unit 174 and drives the nozzle unit 112 (S10).

When the defective nozzle is detected, information on the defective nozzle is stored in the memory unit 171, and after that, the information is transmitted to the data processing unit 172 and the control signal generation unit 173 (S10). The control signal generation unit 173 generates control signals to control the maintenance operating unit 176 and outputs the control signals. The maintenance operating unit 176 receives the control signals to control the operations of the maintenance unit 122 to perform a maintenance operation to recover the nozzle unit 112 to the printing standby state (S15). Namely, the control unit 130 performs a maintenance operation such as a recovery operation for the nozzle unit 112 such as spitting and suction, in order to recover the defective nozzle. After the maintenance operation, in order to check whether or not the defective nozzle is recovered, the defective nozzle detection unit 132 detects an occurrence of the defective nozzle (S25). After it is checked whether or not the defective nozzle is recovered (S30), if another defective nozzle is detected or the defective nozzle is not removed, the control unit 130 performs an operation of compensating for the defective nozzle.

Referring to FIGS. 7 and 8, when the defective nozzle is detected, the control unit 130 analyzes image information on the image data which are to be printed at the compensated position PD which is a position printed with the defective nozzle and the image data which are to be printed at the adjacent positions P1, P2, P3, P4, P5, and P6 adjacent to the compensated position PD, and firing states of the nozzles (S35). For example, the control unit 130 compares color information of the image data which are to be printed at the compensated position PD with color information of the image data which are to be printed at the adjacent positions P1, P2, P3, P4, P5, and P6.

Here, the control unit 130 determines whether or not there are image data having a color equal to or similar to those of those of the image data which are to be printed at the compensated position PD among the image data which are to be printed at the adjacent positions P1, P2, P3, P4, P5, and P6. That is, the image data corresponding to the compensated position PD is replaced with the image data corresponding to at least one of the adjacent positions P1, P2, P3, P4, P5, and P6.

Then, a series of processes are performed by the data processing unit 172 according to the information on the defective nozzle transmitted from the memory unit 171.

Next, the control unit 130 exchanges the image data which are to be printed at the compensated position PD with the image data which are to be printed at one of the adjacent positions P1, P2, P3, P4, P5, and P6 according to the analyzed image information in order to compensate for the defective nozzle and performs printing (S40). Here, the to-be-printed image data denote original image data which are image data input from the data input unit 135, and the exchanged image data denote image data printed at positions different from original positions due to exchange of the positions when the defective nozzle is detected. For example, when the input image data is printed as the original data, it is assumed that black ink and cyan ink are fired at the compensated position PD and the adjacent position P2, respectively. Here, the to-be-printed image data denote the black ink which is to be printed at the compensated position PD, and the exchanged image data denote the cyan ink printed at the compensated position PD in order to compensate for the defective nozzle and the black ink printed at the adjacent position P2.

The image data which are to be printed at the compensated position PD may be exchanged for the image data formed by firing at least one color among adjacent positions P1, P2, P3, P4, P5, and P6. This is because, if the image data which are to be printed at the compensated position PD are exchanged for the image data formed by not firing ink, a deterioration in image quality may occur, such as white lines caused by the defective nozzle.

In addition, image data which are to be printed at the compensated position PD is exchanged for image data not including a color equal to that of the defective nozzle among the image data which are to be printed at the adjacent positions P1, P2, P3, P4, P5, and P6. The ink having a color corresponding to the defective nozzle is not fired at the compensated position PD. Therefore, if image data including ink having a color equal to that of the defective nozzle among the image data which are to be printed at the adjacent positions P1, P2, P3, P4, P5, and P6 is exchanged for the image data which are to be printed at the compensated position PD, an original color cannot be represented due to the defective nozzle. For example, it is assumed that the original image data which are to be printed at the compensated position PD and the image data which are to be printed at the adjacent position P2 are a color of cyan + yellow and a color of cyan + magenta, respectively.

In order to compensate for the defective nozzle, if the image data are exchanged for each other and printed, the colors different from the color of cyan + magenta are printed at the compensated position PD due to the defective nozzle. Therefore, the image data which are to be printed at the compensated position PD are exchanged for image data not including the color equal to that of the defective nozzle among the adjacent positions P1, P2, P3, P4, P5, and P6. Namely, image data of a color equal to that of the image data which are to be printed at the adjacent positions is selected as the exchanged image data and is printed at the compensated position PD.

In addition, image data of a color equal to that of the image data which are to be printed at the compensated position PD is selected as the exchanged image data and printed at the adjacent position. In other words, the image data which are to be printed at the compensated position PD are exchanged for image data of positions where a nozzle firing ink having a color equal to that of the defective nozzle is not defective.

In addition, in order to improve a compensation effect, image data which are to be printed at the compensated position PD are exchanged for image data having chroma similar to chroma of image data which are to be printed at the compensated position PD among the image data which are to be printed at the adjacent positions P1, P2, P3, P4, P5, and P6.

If a defect occurs at any one of cyan, magenta, yellow, and black nozzles, the image data is exchanged. In general, since a black ink is most frequently used during the printing operation, a probability of an occurrence of a defective nozzle is highest in the black nozzle. Therefore, a life time of the print head can be prolonged by compensation of a defect in the black nozzle.

In the present embodiment, the image data which are to be printed at the compensated position PD is black. In other words, the image data of black is printed at the adjacent position and is printed with the exchanged image data. Under normal conditions, the image data of black is fired from the black nozzle. However, if the adjacent black nozzle is a defective nozzle, cyan, magenta, and yellow nozzles fire ink at the adjacent black nozzle in order to form a Composite Black.

As described above, according to the present embodiment, in order to compensate for the defective nozzle, the image data which are to be printed at the compensated position PD are exchanged with the image data printed at one of the adjacent positions P1, P2, P3, P4, P5, and P6 and printing is performed. In the present embodiment, as a method of exchanging the image data, driving data transmitted to the nozzles of the nozzle unit 112 are exchanged with each other, so that the image data are exchanged for each other and printing is performed. Namely, the data processing unit 172 exchanges the image data which are to be fired from the nozzles, and after that, transmits the exchanged image data to the nozzles in the nozzle unit 112.

A method of defective nozzle compensation according to the present embodiment will be described with reference to FIGS. 9 and 10.

Figure 9:
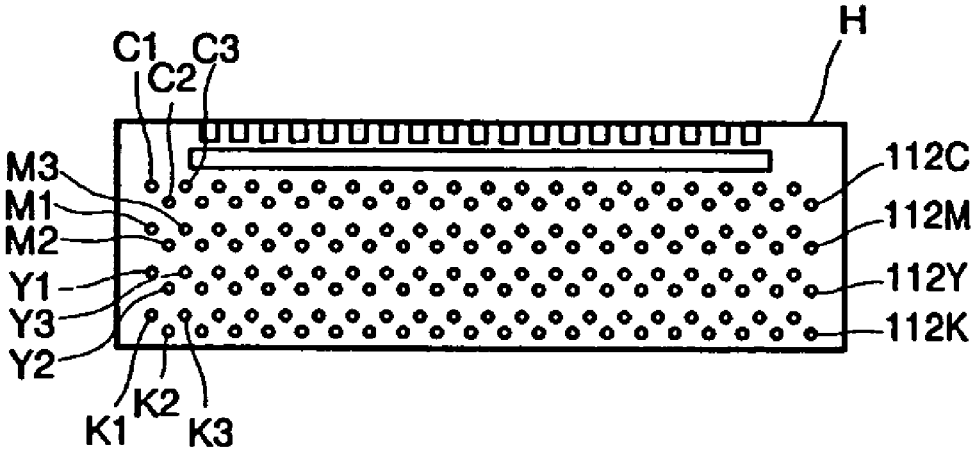
FIG. 9 is an enlarged view illustrating a head chip illustrated in FIG. 4.
Figure 10:
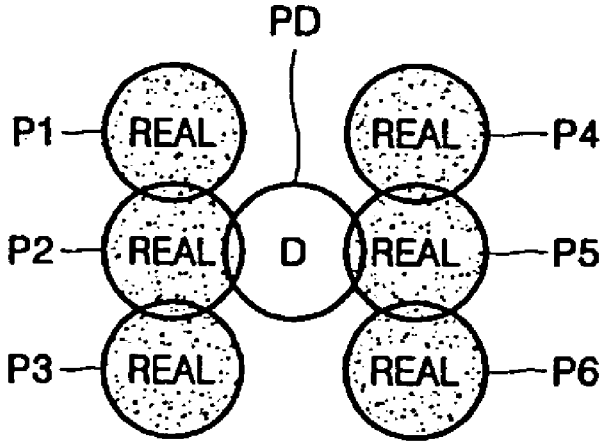
FIG. 10 is a view illustrating image data which are printed at the adjacent positions illustrated in FIG. 8.

FIG. 9 is an enlarged view illustrating the head chip H of FIG. 4; and FIG. 10 is a view illustrating image data which are really printed at the adjacent positions shown in FIG. 8. In FIG. 9, reference numerals C1, C2, C3, . . . , M1, M2, M3 . . . , Y1, Y2, Y3, . . . , and K1, K2, K3, . . . denote nozzles firing cyan, magenta, yellow, and black ink, respectively. In addition, in FIG. 10, reference numeral REAL denotes image data which are really printed at the adjacent positions. For example, assuming that image data of a cyan+magenta color is printed, if the cyan nozzle is a defective nozzle, image data of a magenta color is printed at the position P1 of FIG. 10. Therefore, the reference numeral REAL denotes the image data of the magenta color which is really printed at the position P1.

Referring to FIGS. 9 and 10, the positions P1, P2, and P3 are printed with ink fired from the nozzles C1, M1, Y1, and K1, the position PD is printed with ink fired from the nozzles C2, M2, Y2, and K2, and the positions P4, P5, and P6 are printed with ink fired from the nozzles C3, M3, Y3, and K3. The position PD position can be printed with image data of cyan, magenta, yellow, or black, or the image data of a composite color of ink fired from the nozzles. For example, it is assumed that in a case where the yellow nozzle Y2 is a defective nozzle, image data which are to be printed at the compensated position PD is the image data of a yellow+cyan color, and the image data printed at the position P5 of the adjacent positions is the image data of a cyan+magenta color. Since the yellow nozzle Y2 is the defective nozzle, if printing is performed without the processing of the present embodiment, the image data of the cyan color is printed at the compensated position PD. Namely, the image data of a color different from that of original image data is printed at the compensated position PD. A defect does not occur in the cyan nozzle C2 or the magenta nozzle M2 among the nozzles firing ink at the compensated position. Therefore, the image data of the cyan+magenta color which are to be fired at the adjacent position P5 is printed at the compensated position PD, and the image data of the yellow+cyan color which are to be fired at the compensated position PD are printed at the position P5, so that deterioration in image quality caused by the defective nozzle can be compensated. Since an interval between ink dots printed on an actual printing medium is very small, the exchange of image data cannot be perceived with human eyes. Accordingly, by exchanging the image data and performing printing with the aforementioned defective nozzle compensation method, it is possible to prevent deterioration in image quality caused by defective nozzles. Such a deterioration in image quality may include, for example, white bands caused by firing failure of defective nozzles.

In this manner, in the aforementioned method and system of the present general inventive concept, in order to compensate for the defective nozzle, the image data printed at the compensated position is exchanged for the image data printed at one of the adjacent positions and printing is performed.

Unlike a conventional method, according to an inkjet image forming apparatus and a method of defective nozzle compensation in the inkjet image forming apparatus of the present general inventive concept, the image data are exchanged for each other and printed, so that it is possible to prevent deterioration in image quality such as a white band which can be easily perceived by a user. In addition, unlike a conventional technique, according to the present general inventive concept, defects of other color nozzles as well as a black nozzle can be compensated for. In addition, a defective nozzle can be compensated by taking into consideration a difference of chroma between image data which are to be printed at a compensated position and image data which are to be printed at adjacent positions, so that a compensation effect is improved. In addition, according to the present general inventive concept, compensation may be made for a defective nozzle and the defective nozzle can be used again, so that life time of a print head can be prolonged.

The present general inventive concept can also be embodied as computer-readable codes on a computer-readable recording medium. The computer-readable recording medium is any data storage device that can store data which can be thereafter read by a computer system. Examples of the computer-readable recording media include read-only memory (ROM), random-access memory (RAM), CD-ROMs, magnetic tapes, floppy disks, optical data storage devices, and carrier waves (such as data transmission through the Internet). The computer-readable recording medium can also be distributed over network-coupled computer systems so that the computer-readable code is stored and executed in a distributed fashion. Also, functional programs, codes, and code segments to accomplish the present general inventive concept can be easily construed by programmers skilled in the art to which the present general inventive concept pertains. The method illustrated in FIG. 7 can be stored in the computer-recorded medium in a form of computer-readable codes to perform the method when the computer reads the computer-readable codes of the recording medium.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of compensating a defective nozzle in an inkjet image forming system, comprising:

detecting an occurrence and a position of the defective nozzle in a nozzle unit;

analyzing image information on image data which are to be printed at a compensated position which is a position printed with the detected defective nozzle and image data which are to be printed at one or more positions adjacent to the compensated position;

exchanging the image data which are to be printed at the compensated position with image data which are to be printed at one of the adjacent positions according to the analyzed image information and without adding image data; and performing printing using the exchanged image data.

2. The method of claim 1, wherein the analyzing of the image information comprises comparing color information of the image data which are to be printed at the compensated position with color information of the image data which are to be printed at the adjacent positions.

3. The method of claim 2, wherein the analyzing of the image information comprises, after the color information of the image data which are to be printed at the compensated position is compared with the color information of the image data which are to be printed at the adjacent positions, determining whether there is the image data having a color equal to that of the image data which are to be printed at the compensated position among the image data which are to be printed at the adjacent positions.

4. The method of claim 1, wherein the image data which are to be printed at the compensated position is exchanged with the image data formed by firing ink of at least one of the colors of the image data which are to be printed at the adjacent positions.

5. The method of claim 1, wherein the image data which are to be printed at the compensated position is exchanged with image data not including ink having a color equal to that of the defective nozzle among the image data which are to be printed at the adjacent positions.

6. The method of claim 5, wherein image data having the color equal to that of the image data which are to be printed at the adjacent positions is selected as the exchanged image data to be printed at the compensated position.

7. The method of claim 1, wherein image data having the colors equal to those of the image data which are to be printed at the compensated position are printed at the adjacent positions printed with the exchanged image data.

8. The method of claim 1, wherein the image data which are to be printed at the compensated position are exchanged with the image data having chroma similar to those of image data which are to be printed at the compensated position among the image data which are to be printed at the adjacent positions.

9. The method of claim 1, wherein the image data which are to be printed at the compensated position has a black color.

10. The method of claim 9, wherein black ink is fired at the adjacent positions according to the exchanged image data.

11. The method of claim 9, wherein cyan, magenta, and yellow inks are fired at the adjacent positions according to the exchanged image data.

12. The method of claim 1, wherein the exchange and printing of the image data are performed by exchanging and transmitting of driving data transmitted to the nozzles of the nozzle unit.

13. The method of claim 1, wherein the adjacent positions comprise left, upper left, and lower left, right, upper right, and lower right positions of the compensated position.

14. The method of claim 1, wherein the nozzle unit has a length greater than or equal to a width of a printing medium.

15. The method of claim 1, further comprising:

when the defective nozzle is detected, performing a maintenance operation to recover the nozzle unit to a printing standby state.

16. The method of claim 15, further comprising:

after the maintenance operation is performed, detecting the occurrence and the position of the defective nozzle in the nozzle unit.

17. An inkjet image forming system comprising:

a print head having a nozzle unit to fire ink;

a driving member to drive the nozzle unit to form an image on a printing medium;

a defective nozzle detection unit to detect an occurrence and a position of the defective nozzle in the nozzle unit; and a control unit to control an operation of the driving member, to analyze image information on image data which are to be printed at a compensated position which is a position printed with the detected defective nozzle and image data which are to be printed at one or more positions adjacent to the compensated position, to exchange image data which are to be printed at a compensated position which is a position printed by the detected defective nozzle with image data which are to be printed at one of positions adjacent to the compensated position and without adding image data, and to perform printing using the exchanged image data of the detected defective nozzle.

18. The inkjet image forming apparatus of claim 17, wherein the control unit controls an operation of the driving member to exchange the image data which are to be printed at the compensated position with the image data not including ink having a color equal to that of the defective nozzle among the image data which are to be printed at the adjacent positions.

19. The inkjet image forming apparatus of claim 17, wherein the control unit controls an operation of the driving member to exchange image data which are to be printed at the compensated position with image data having chroma similar to that of the image data which are to be printed at the compensated position among the image data which are to be printed at the adjacent positions.

20. The inkjet image forming apparatus of claim 17, wherein the nozzle unit has a length greater than or equal to a width of the printing medium.

21. A method of compensating a defective nozzle in an inkjet image forming system, comprising:

detecting an occurrence of the defective nozzle in a nozzle unit;

when the defective nozzle is detected, performing a maintenance operation to recover the nozzle unit;

determining whether the defective nozzle is recovered or continues to be defective;

when the defective nozzle continues to be defective:

detecting a position of the defective nozzle;

analyzing image information on image data which are to be printed at a compensated position which is a position printed using the defective nozzle and image data which are to be printed at positions adjacent to the compensated position; and exchanging the image data which are to be printed at the compensated position with the image data which are to be printed at one of the adjacent positions according to the analyzed image information; and performing printing of the exchanged image data.

22. A method of compensating a defective nozzle in an inkjet image forming system, comprising:

detecting an occurrence of the defective nozzle in a nozzle unit; and performing printing with image data which are to be printed at a position adjacent to a compensated position which is in a position printed using the defective nozzle by analyzing image information on image data which are to be printed at a compensated position which is a position printed with the defective nozzle and image data which are to be printed at one or more positions adjacent to the compensated position, and exchanging image data which are to be printed at the compensated position with the image data which are to be printed at the position adjacent to the compensated position and without adding image data.

23. An image forming system, comprising:

a data input unit to receive and transmit image data and to generate commands; and an image forming apparatus to receive the transmitted image data and the generated commands from the data input unit and to form an image based on the received image data and commands, the image forming apparatus comprising:

a print head having a nozzle unit to fire ink;

a driving member to drive the nozzle unit to form an image on a printing medium;

a defective nozzle detection unit to detect an occurrence and a position of a defective nozzle in the nozzle unit;

a maintenance unit to recover the defective nozzle unit when the occurrence of the defective nozzle is detected; and a control unit to control an operation of the driving member based on the generated commands and to analyze image information on received image data which are to be printed at a compensated position which is a position printed using the defective nozzle and image data which are to be printed at positions adjacent to the compensated position, and to exchange the received image data which are to be printed at the compensated position with the received image data which are to be printed at the adjacent positions and without adding image data and to print the exchanged image data.

24. The image forming system of claim 23, wherein the defective nozzle detection unit further comprises:

a first detection unit to detect whether a nozzle of the nozzle unit is clogged based on illumination of the nozzle unit; and a second detection unit to detect whether the nozzle is defective based on illumination of the printing medium.

25. An inkjet image forming system comprising:

a print head having a nozzle unit to fire ink;

a driving member to receive image data and to drive the nozzle unit to form an image on a printing medium;

a defective nozzle detection unit to detect a defective nozzle in the nozzle unit; and a control unit to analyze image information on image data which are to be printed at a compensated position which is a position printed with the defective nozzle and image data which are to be printed at one or more positions adjacent to the compensated position, to control an exchange of image data which are to be printed at a compensated position which is in a position printed using the defective nozzle with image data which are to be printed at a position adjacent to the compensated position and without adding image data, and to control an operation of the driving member and the print head to print with the image data which are to be printed at the position adjacent to a compensated.

26. The image forming system of claim 25, wherein the image forming apparatus further comprises:

a printing speed determination unit to determine a printing speed of the print head;

a maintenance operation unit to recover the print head; and a printing medium conveying unit to convey the printing medium, wherein the control unit controls the driving member and a firing operation of the nozzle unit of the print head, operation of the maintenance unit to recover the print head, and operation of the printing medium conveying unit.

27. A computer-readable medium having embodied thereon a computer program to execute a method of compensating a defective nozzle in an inkjet image forming system, the method including:

detecting an occurrence and a position of the defective nozzle in a nozzle unit;

analyzing image information on image data which are to be printed at a compensated position which is a position printed with the detected defective nozzle and image data which are to be printed at positions adjacent to the compensated position;

exchanging the image data which are to be printed at the compensated position with image data which are to be printed at one of the adjacent positions according to the analyzed image information and without adding image data; and performing printing using the exchanged image data.

28. A computer-readable medium having embodied thereon a computer program to execute a method of compensating a defective nozzle in an inkjet image forming system, the method including:

detecting an occurrence of the defective nozzle in a nozzle unit;

when the defective nozzle is detected, performing a maintenance operation to recover the nozzle unit;

determining whether the defective nozzle is recovered or continues to be defective;

when the defective nozzle continues to be defective:

detecting a position of the defective nozzle;

analyzing image information on image data which are to be printed at a compensated position which is a position printed using the defective nozzle and image data which are to be printed at positions adjacent to the compensated position; and exchanging the image data which are to be printed at the compensated position with the image data which are to be printed at one of the adjacent positions according to the analyzed image information; and performing printing of the exchanged image data.

29. A computer-readable medium having embodied thereon a computer program to execute a method of compensating a defective nozzle in an inkjet image forming system, the method including:

detecting an occurrence of the defective nozzle in a nozzle unit; and performing printing with image data which are to be printed at a position adjacent to a compensated position which is in a position printed using the defective nozzle by analyzing image information on image data which are to be printed at a compensated position which is a position printed with the defective nozzle and image data which are to be printed at one or more positions adjacent to the compensated position, and exchanging image data which are to be printed at the compensated position with the image data which are to be printed at the position adjacent to the compensated position and without adding image data.

* * * * *